US005146648A

United States Patent [19]

Hudson

[11] Patent Number: 5,146,648

[45] Date of Patent: Sep. 15, 1992

[54] MOUNTING BRACKET

[75] Inventor: Peter W. Hudson, Woldingham, United Kingdom

[73] Assignee: Hallis Hudson Group Limited, Preston, United Kingdom

[21] Appl. No.: 582,752

[22] Filed: Sep. 14, 1990

[30] Foreign Application Priority Data

Sep. 15, 1989 [GB] United Kingdom ..... 89 20965

[51] Int. Cl.[5] ..... A47H 1/04

[52] U.S. Cl. ..... 16/94 R; 248/261

[58] Field of Search ..... 248/261, 262, 263, 264, 248/251, 252, 254, 253, 267; 160/345, 126; 16/94 R, 94 T

[56] References Cited

U.S. PATENT DOCUMENTS

| | | | |
|---|---|---|---|
| 1,299,003 | 4/1919 | Morris et al. | 248/262 |
| 3,273,197 | 9/1966 | Ford | 160/345 X |
| 4,120,474 | 10/1978 | Hurley | 248/263 |
| 4,240,178 | 12/1980 | Miki | 160/345 X |
| 4,399,917 | 8/1983 | Ohman | 248/262 X |
| 4,406,435 | 9/1983 | Anderson | 248/261 |
| 4,580,753 | 4/1986 | Hennequin | 248/264 |

*Primary Examiner*—Ramon O. Ramirez
*Attorney, Agent, or Firm*—Spensley, Horn, Jubas & Lubitz

[57] ABSTRACT

A bracket for mounting a curtain rail having a channel defined by flanges has a body for securement to a wall for example and parallel mounting fingers for insertion into the channel and clamping engagement with the channel flanges. This clamping engagement is effected by a rotatable cam being carried by the body and which serves to splay the fingers apart.

7 Claims, 1 Drawing Sheet

MOUNTING BRACKET

This invention relates to a bracket for mounting a curtain rail or other tracked rail on a wall or other vertical surface.

For convenience reference will be made hereinafter and in the claims to "curtain rails".

The curtain rail per se does not form part of the present invention.

One example of curtain rail which is suitable for mounting on a surface by brackets according to this invention comprises a facia strip from the back of which extend at right angles to the facia strip three parallel flanges which when the curtain rail is in use define two vertically spaced horizontal tracks. The two upper flanges, considering the curtain track in its in-use position, are of T-cross-section while the bottom flange is of L-cross-section.

Conventionally such a curtain track has been secured to a wall by brackets having fingers which engage the upper and bottom edges of the crossbar of the T-shaped upper flange, the fingers being clamped together by releasable screws. The fingers extend from a body through which the bracket is screwed to a wall.

It is an object of the present invention to provide a curtain rail mounting bracket which provides an improved and a more substantial gripping force between the bracket and the curtain rail than hitherto and which dispenses with clamping screws.

According to the present invention there is provided a bracket for mounting a curtain rail of the type hereinbefore described, the bracket comprising a body through which the bracket can be secured to a wall, a pair of parallel mounting fingers extending from the body for insertion within a channel of the curtain rail, and cam means carried by the body and operable to splay the mounting fingers apart to urge them into clamping engagement with the flanges defining the channel.

Preferably each mounting finger is grooved on its flange-adjacent surface to receive and engage the crossbar of its respective T-shaped flange.

Preferably, the body is formed with a bore open to the gap between the mounting fingers, the bore rotatably mounting a cam shaft having at one end external of the body an operating lever.

Preferably the cam shaft at its other end has an enlargement preventing its axial withdrawal from the bore.

Preferably, in one position of the cam shaft, the mounting fingers are insertible within and removable from the upper track of the curtain rail, while, in another position, the mounting fingers are splayed apart into their flange clamping position if within the track, or, if not within the track, they are splayed apart a distance preventing their insertion.

Preferably, the mounting fingrers, at their channel insertion ends, are tapered to facilitate insertion of the fingers into the curtain rail channel.

Preferably the mounting bracket and its associated cam shaft are moulded from a plastics material.

An embodiment of the present invention will now be described, by way of example with reference to the accompanying drawings, in which.

For convenience hereinafter the curtain rail will be described and referred to in one of its in-use positions, i.e. wall mounted.

Figure 1:
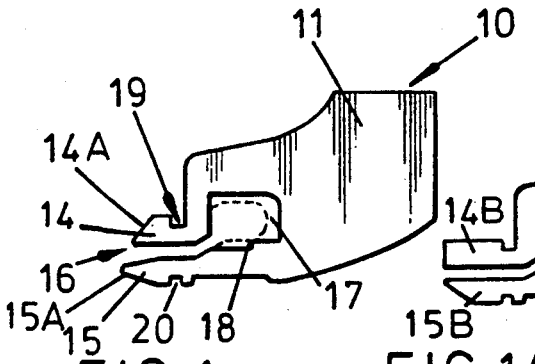
FIGS. 1 to 3 are respectively a side view, a front view and a plan view of the mounting bracket.
Figure 2:
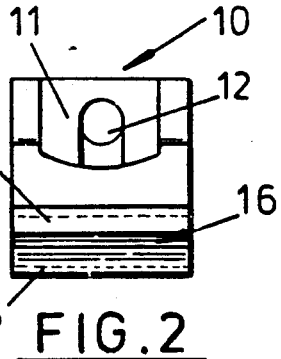
Figure 3:
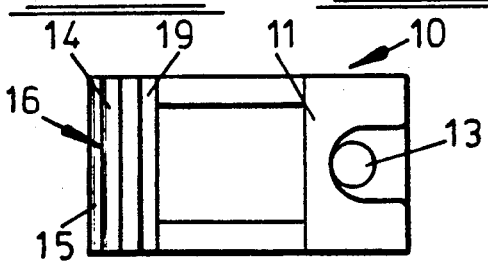

The mounting bracket 10 (FIGS. 1 to 3) is of moulded plastics construction and comprises a body 11 of stepped configuration in side view (see FIG. 1).

The body 11 is traversed by two securing holes or passages 12, 13 at right angles one to another whereby the bracket 10 can be secured to a vertical surface such as a wall for example, or a horizontal surface such as the upper surface of a window opening for example.

The body 11 has extending outwardly from one side thereof two parallel mounting fingers 14, 15 spaced apart by a gap 16.

This gap 16 into a bore 17 traversing the body from end to end, the bore 17 internally being formed with a step configuration 18 with which a cam shaft cooperates as hereinafter described.

The gap 16 and associated bore 17 provide a certain resilience between the fingers 14, 15 permitting variation in the spacing between the fingers 14, 15.

The upper surface of the finger 14 adjacent the body 11 is formed with a groove 19 and a corresponding groove 20 is formed in the lower surface of the finger 15.

A cam shaft 21 also of moulded plastics construction is rotatably mounted in the bore 17, which cam shaft 21, at one end, is formed with an enlargement 22 preventing its axial dislodgement from the bore 17. The cam shaft 21, at its other end, is provided with an operating lever 23 by means of which the cam shaft 21 can be rotated within the bore 17. The operating lever 23 has a lateral wing 24 (a thumbpiece) to facilitate its operation.

Figure 6:
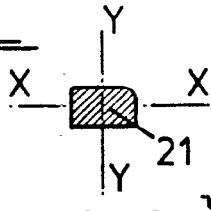
FIG. 6 is a sectional view of the line VI—VI of FIG. 4.
Figure 7:
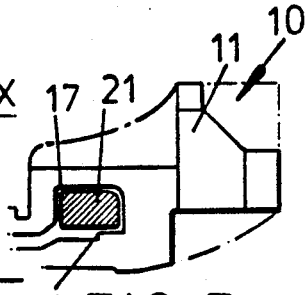
FIG. 7 is a part-sectional end view of the bracket and cam shaft.
Figure 5:
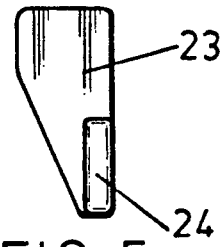
FIG. 4 and 5 are respectively a front view and a side view of the cam shaft and its operating lever.
Figure 4:
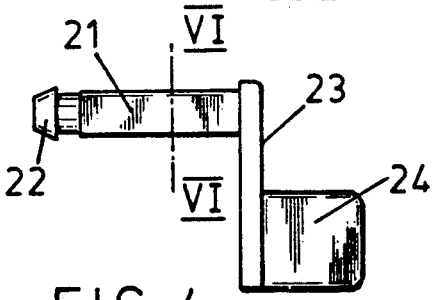
Figure 8:
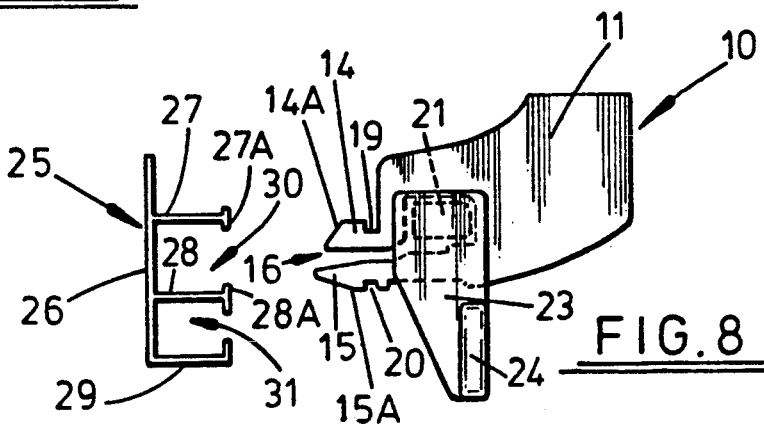
FIG. 8 is a side view of a curtain rail and associated mounting bracket in accordance with FIGS. 1 to 3.

It will be seen from FIG. 6 that the cam shaft 21 is dimensionally longer along axis X—X than it is along axis Y—Y so that if the cam shaft 21 is pivoted or hinged through 90° about the corner of the step configuration 18 to move axis X—X from a horizontal position to a vertical position this causes the mounting finger 15 to be moved away from mounting finger 14 thereby increasing the gap 16 and the overall vertical dimension between the upper surface of the finger 14 and the lower surface of finger 15.

The curtain rail 25 which brackets 10 as described above are adapted to mount, is, for example, of extruded aluminium construction, and comprises a facia strip 26 from the back face of which extend three parallel flanges 27, 28 and 29 defining two vertically-spaced horizontal channels 30 and 31.

The upper flanges 27 and 28 are of T-cross-section while the bottom flange is of L-cross-section.

The upper channel 30 is employed for bracket-engaging and mounting purposes while the lower track 31 is adapted to receive curtain sliders or rollers (not shown).

It is to be noted that the bottom finger 15 extends beyond the top finger 14, i.e. it is longer, and that the fingers 14 and 15 are provided with tapering surfaces 14A and 15A respectively to facilitate insertion of these fingers 14, 15 into the channel 30.

To mount the curtain rail 25 on a wall a selected number of brackets 10 is employed depending on the length of the curtain rail 25 and possibly the drop and weight of the curtains to be supported.

The brackets 10 are mounted by screws (not shown) in the required positions on a wall and the curtain rail 25 is presented to the brackets 10 either frontally or endwise so that the crossbars 27A, 28A of the flanges 27, 28 engage respectively in the grooves 19, 20. At this time the cam shafts 21 have their axes X—X horizontal. The operating levers 23 of the brackets 10 are now operated, in turn, to move the cam shafts 21 through 90° which splays the fingers 14, 15 apart providing a substantial clamping or gripping force on the flanges 27, 28 of the curtain rail 25.

As a result a very stable and secure mounting is provided for the curtain rail and the need to tighten clamping screws with a screwdriver is avoided.

To release the curtain rail 25 the operating levers 23 are simply returned through the 90° arc to bring cam shaft axes X—X back to the horizontal position. The curtain rail 25 can then be disengaged from the brackets 10.

Figure 1A:
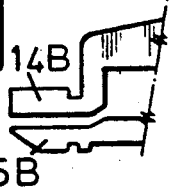
FIG. 1A is a detail view of a modification of the mounting bracket at the channel insertion ends of the fingers.

In the modified bracket shown in FIG. 1A, the fingers 14B and 15B are the same length and, while the bottom surface of the finger 15B is tapered, its top surface and the top and bottom surfaces of the finger 14B are parallel and rectilinear.

It is to be clearly understood that mounting brackets according to this invention can be employed with any form of curtain or other rail having a channel within which the mounting fingers can be inserted and splayed apart to grip flanges defining the channel.

I claim:

1. A curtain rail assembly comprising:

(A) (i) a curtain rail constituted by a facia strip having a back surface;

(ii) three parallel and vertically-spaced flanges extending along the facia strip from, and at right angles to, the back surface to define, when the curtain is in a horizontal in-use position two parallel, vertically-shaped tracks, namely an upper mounting track and a lower track for receiving curtain-supporting sliders; the upper and middle flanges being of T-cross-section with the crossbar of each T vertical and the lower flange being of L-cross-section; and (B) a plurality of brackets for mounting the curtain rail in horizontal disposition on a wall, each bracket including:

a body adapted to be secured to the wall;

a pair of parallel and vertically-spaced mounting fingers extending from the body and engaged in the upper track of the curtain rail;

a rotatable cam supported within the space in the body between the mounting fingers; and means connected with the cam for rotating the came to urge the mounting fingers apart into locking engagement with the crossbars of the T-section upper and middle flanges.

2. A mounting bracket as claimed in claim 1, wherein each mounting finger is grooved on its flange-adjacent surface to receive and engage the crossbar of its respective T-shaped flange of the curtain rail.

3. A mounting bracket as claimed in claim 1, wherein the body is formed with a bore open to a gap between the mounting fingers, the bore rotatably mounting the cam having at one end external of the body an operating lever.

4. A mounting bracket as claimed in claim 3 wherein the cam at its other end has an enlargement preventing its axial withdrawal from the bore.

5. A mounting bracket as claimed in claim 1, wherein, in one position of the cam, the mounting fingers are insertable within and removable from the upper track of the curtain rail, while, in another position, the mounting fingers are splayed apart into their flange clamping position if within the track, or, if not within the track, they are splayed apart a distance preventing their insertion.

6. A mounting bracket as claimed in claim 1, wherein, the mounting fingers, at their channel insertion ends, are tapered to facilitate insertion of the fingers into the upper track of the curtain rail.

7. A mounting bracket as claimed in claim 1, wherein the mounting bracket and its associated cam are molded from a plastics material.

* * * * *